US006145620A

United States Patent [19]

Strunk

[11] Patent Number: 6,145,620

[45] Date of Patent: Nov. 14, 2000

[54] WORK SUPPORT ASSEMBLY FOR USE WITH STEPLADDER

[76] Inventor: Norman Strunk, Box 46, R.R. 6, Site 601, Saskatoon, Canada, S7K 3J9

[21] Appl. No.: 09/281,233

[22] Filed: Mar. 30, 1999

[51] Int. Cl.[7] ..... E06C 7/00

[52] U.S. Cl. ..... 182/129; 182/107

[58] Field of Search ..... 182/129, 106, 182/141, 165, 107

[56] References Cited

U.S. PATENT DOCUMENTS

| | | | |
|---|---|---|---|
| 808,252 | 12/1905 | Padon | 182/129 |
| 2,167,157 | 7/1939 | Muehlberg | 182/129 |
| 3,208,555 | 9/1965 | Fry | 182/129 |
| 3,490,558 | 1/1970 | Foley | 182/129 |
| 4,418,793 | 12/1983 | Brent . | |
| 5,120,013 | 6/1992 | Sweeney . | |
| 5,171,003 | 12/1992 | Kull | 269/97 |
| 5,544,718 | 8/1996 | Schumacher . | |

FOREIGN PATENT DOCUMENTS

| | | | |
|---|---|---|---|
| 107 014 | 12/1899 | Germany | 182/106 |
| 368499 | 3/1932 | United Kingdom | 182/129 |

*Primary Examiner*—Alvin Chin-Shue

*Attorney, Agent, or Firm*—Nixon & Vanderhye, P.C.

[57] ABSTRACT

A height adjustable work support assembly to be used primarily as an integral part of a stepladder. It includes a work support tube (1) with interchangeable platform bases (10). The work support tube extends downward through the top of the ladder (2), and is held in position and guided by a pivoting lock plate (3) attached to the top of the ladder by a supporting plate (4). A pivoting guide bushing assembly located at a lower level, supports the tube (1) in the vertical position. The lock plate (3) and guide bushing assembly can be pivoted upward/downward with the closing of the ladder, permitting the work support tube (1) to be pivoted and held within the confines of the folded ladder. When the work support tube is pivoted, the spring loaded locking washer (6) locks the work support tube in the reverse direction, preventing it from sliding out of the ladder while storing or transporting.

6 Claims, 5 Drawing Sheets

Fig. 5
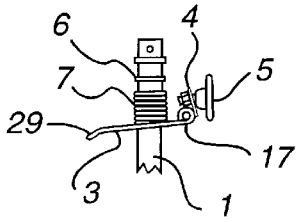
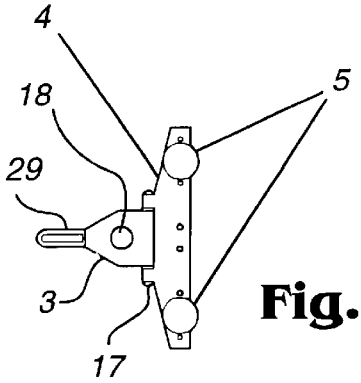
Fig. 6
Fig. 7
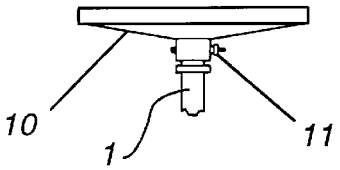
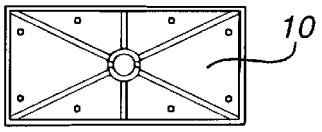
Fig. 8
Fig. 9
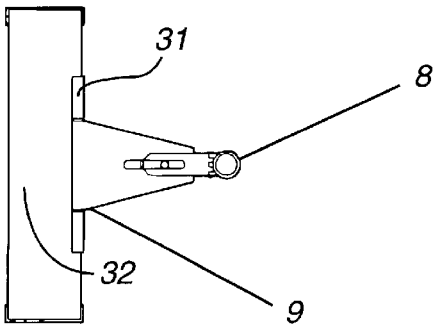
Fig. 11
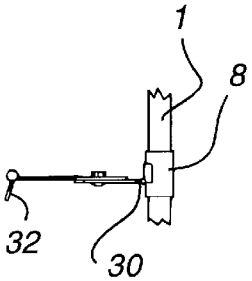
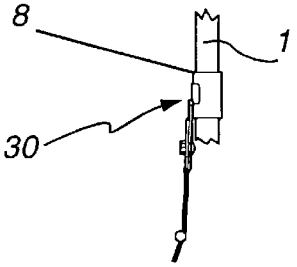
Fig. 10

WORK SUPPORT ASSEMBLY FOR USE WITH STEPLADDER

This invention relates to a work support assembly for use in conjunction with a device such as a stepladder. More particularly, this invention relates to a work support assembly including an elongated tube for extending up through a space or aperture defined in some part of a stepladder or the like. In certain embodiments, the tube is approximately centrally located as to the ladder so as to reduce the likelihood of tipping of the ladder.

BACKGROUND OF THE INVENTION

There have been various attempts to provide a variable height surface on a ladder for the support of tools, parts, and other materials. Examples are "Ladder Lift With Swivel Tray" (U.S. Pat. No. 5,544,718), "Ladder Shelf" (U.S. Pat. No. 5,120,013), and "Ladder Aid Device" (U.S. Pat. No. 4,418,793), all of which are hereby incorporated herein by reference.

The devices of the aforesaid patents have numerous problems and fail to provide important features that certain embodiments of the instant invention incorporate, such as: central location relative to the ladder assembly, simplicity, versatility, light weight, portability, ease of adjustment, and/or storability within the confines of the ladder.

In U.S. Pat. No. 5,544,718, the swivel tray assembly does not provide stability because as it is raised, the load is shifted further and further off center in many locations of the tray. This is potentially dangerous. The device is not versatile in that it has limited use and limited adjustment. The device further incorporates two sizeable steel shafts and tubes which add considerable weight to the ladder. Because the device is mounted to the outside of the ladder it will interfere with the transportation and storage of the assembly, and potentially with a user climbing up the ladder.

In U.S. Pat. No. 5,120,013, the assembly is mounted entirely on the rear legs of the ladder, making it potentially unstable. This of course is dangerous, and could potentially interfere with a user climbing the ladder. The device is not versatile and would add considerable weight to the ladder. The device also cannot be adjusted while standing on the ladder and would be difficult to carry and store. Moreover, the material being supported by the shelf of the '013 patent would be located substantially off-center of the ladder thereby increasing the liklihood of ladder tipping.

In U.S. Pat. No. 4,418,793, the assembly is simple but has limited use. The device is mounted on one side edge of the ladder and is raised at an angle. The further it is raised the more unstable the assembly becomes, especially when material of considerable weight is on the shelf.

It is apparent from the above that there exists a need in the art for a variable level support for use with a stepladder or the like which is simple, can be used to provide a vertically adjustable support surface, does not substantially increase instability of the ladder, can support work material approximately near the center of the ladder so as to minimize the potential for ladder tipping, can be stored within the ladder, is versatile, can be used when both leg portions of the stepladder are extended opposite from one another, and/or can be used when only one leg portion of the ladder is being used to support the ladder (e.g. when the ladder is being leaned up against a wall or the like).

SUMMARY OF THE INVENTION

A purpose of certain embodiments of this invention is to provide a handyman or contractor with an extra hand in raising, lowering, or supporting various objects to whatever height is required within the work support tube's working limits, and which can be used with a ladder device free-standing or while leaning against a vertical wall. In certain embodiments, an elongated tube of the support device can at least partially, or entirely, be stored within the confines of the ladder.

In certain embodiments, the tube extends vertically and is approximately centered in all lateral directions relative to the opposing ladder legs to minimize the potential for ladder tipping.

Because of the compact and simple design in certain embodiments, there is very little weight added to the ladder as a whole, thereby maintaining easy portability.

The pivoting lock plate assembly in certain embodiments, while guiding and supporting the work support tube, allows infinite height adjustment within the upper and lower limits of the work support tube(s), and provides a quick release for lowering. When the work support is folded, in certain embodiments a locking washer prevents the work support tube from sliding out.

The approximately centered work support tube is raised vertically thereby maintaining the work (and work support surface) approximately directly over the center of a portion of the ladder no matter what height the tube it is set to.

Another advantage is that the vertically adjustable tube in certain embodiments may be mounted within the confines of the ladder itself, while still permitting the ladder to be folded together and stored as originally intended.

Another advantage is that the complete work support assembly except for the detachable work platform is mounted entirely within the confines of the ladder itself in certain embodiments.

Yet another advantage is that the work support can also be used to support work that is to be mounted on or near a wall when leaning the ladder against the wall.

This invention fulfills the above-described needs in the art in certain embodiments by providing an integral stepladder platform and work support system, wherein the work support system can be folded with or without the stepladder and when folded with, the tube of the support system may be substantially entirely contained and restrained within the confines of the stepladder (i.e. at least mostly between the two opposing leg portions of the stepladder when viewed from the side as in FIGS. 1–2).

In certain embodiments, when storing the ladder, a pivoting lower support plate of the work support system may be tilted upwards and/or outwards while a supporting bushing pivots with respect to the work support tube, and corresponding repositioning of the work support tube causes the upper lock washer to pivot downward so as to lock the work support tube in a reverse direction and in a retracted storage position parallel and next to the ladder's main support legs.

In other embodiments, the ladder can be folded without pivoting the work support tube when the work support tube is at its highest position. The ladder may also be positioned with bumpers attached to the top platform resting directly against a vertical surface (e.g. a wall) and the height of a work support tube can then be adjusted from outside of the ladder's rear support legs.

In certain embodiments of this invention, the system includes an upper pivoting lock plate assembly, a work support tube with interchangeable work support platform bases and quick release mechanism, and an adjustable lower pivoting guide and support bushing assembly.

A reversing upper pivoting lock plate may be provided in certain embodiments, the plate having a centrally located hole or aperture which is large enough to permit the work support tube to freely pass therethrough, yet small enough to fit in order to cause a locking action between the lock plate and the work support tube when the lock plate is pivoted either up or down. A release arm extending outward and opposite the pivot side may be provided on the lock plate.

In other embodiments of this invention, an attached support plate which a lock plate pivots from by hinge or other means is provided, the support plate being mounted to a side (e.g. back side) of the ladder's platform, thereby strengthening the top platform, distributing weight from the lock plate through the platform to the legs of the ladder, and/or incorporating non-marring bumpers to prevent damage when the ladder is leaned against a vertical surface.

In further embodiments, a washer is provided including a hole large enough to permit the work support tube to freely pass therethrough, yet small enough so that a close enough fit is provided with regard to the tube to cause a substantial locking action between the washer and the support tube when the washer is pivoted with respect to the tube.

In certain preferred embodiments, a reversing upper pivoting lock plate is provided so that when in the working position, it binds or locks on the work support tube only in the downward direction, and transfers load from the work support tube through the upper pivoting lock plate to the attached brace.

In certain preferred embodiments, the work support tube has interchangeable work support platform bases, and the tube has a hole at one end perpendicular to the tube length so as to accommodate a quick release pin which keeps the work support platform base in position. The tube may be provided with a collar mounted just below the hole or aperture to prevent the work support tube from dropping through the lock plate when the work platform base is removed. Interchangeable work support platform bases may be provided, each having a centered sleeve on a bottom side thereof which has a bore to accommodate the work support tube and a perpendicular hole for a quick release pin which retains the work support platform on the work support tube. In certain embodiments, interchangeable work support bases may have holes around the perimeter for the mounting of custom work support platforms.

Certain embodiments include a lower pivoting guide and support bushing including a support plate that has a pivot point or hinge on both ends, of which one end is attached at a suitable place on the ladder's main legs (a leg portion) or onto a ladder step/rung, and from which point the support plate can be pivoted up or down from the working horizontal position. The other hinged end may be attached to the lower support bushing. A support plate may be held in the horizontal position by a step or by any other mechanism, but is free to pivot upward. Moreover, a support plate may be adjustable in length for the vertical aligning of the work support tube.

In certain preferred embodiments, a lower pivoting guide and support bushing is provided that keeps the work support tube in approximately a vertical position when being used (e.g. plus or minus 10 degrees from the absolute vertical), allows the tube to be folded within the confines of the stepladder when not in use, and moves parallel to the ladder's step rails when folding the work support tube due to the pivoting action of the bushing and the support plate.

This invention will now be described with respect to certain embodiments thereof, along with reference to the accompanying illustrations.

IN THE DRAWINGS

FIG. 5 is a side elevational view of a lock and guide assembly including a lock plate, of the FIGS. 1–4 embodiment of this invention.

FIG. 6 is a rear view of the lock and guide assembly including plate of FIG. 5, wherein the plate is pivoted downward relative to wall rest members so that the tube aperture in the plate can be seen.

FIG. 7 is a side elevational view of a support member attachable to the top end of the work support tube in accordance with the FIGS. 1–6 embodiment of this invention.

FIG. 8 is a bottom view of the FIG. 7 support member.

FIG. 9 is a top view of a guide bushing including a tube aperture defined therein for slidably receiving the elongated support tube (1), and adjustable pivoting support plate (9), according to the FIGS. 1–8 embodiment of this invention.

FIG. 10 is a side view of the assembly of FIG. 9 in an open position.

FIG. 11 is a side view of the assembly of FIG. 9 in a closed position.

DETAILED DESCRIPTION OF CERTAIN EMBODIMENTS OF THIS INVENTION

Figure 1:
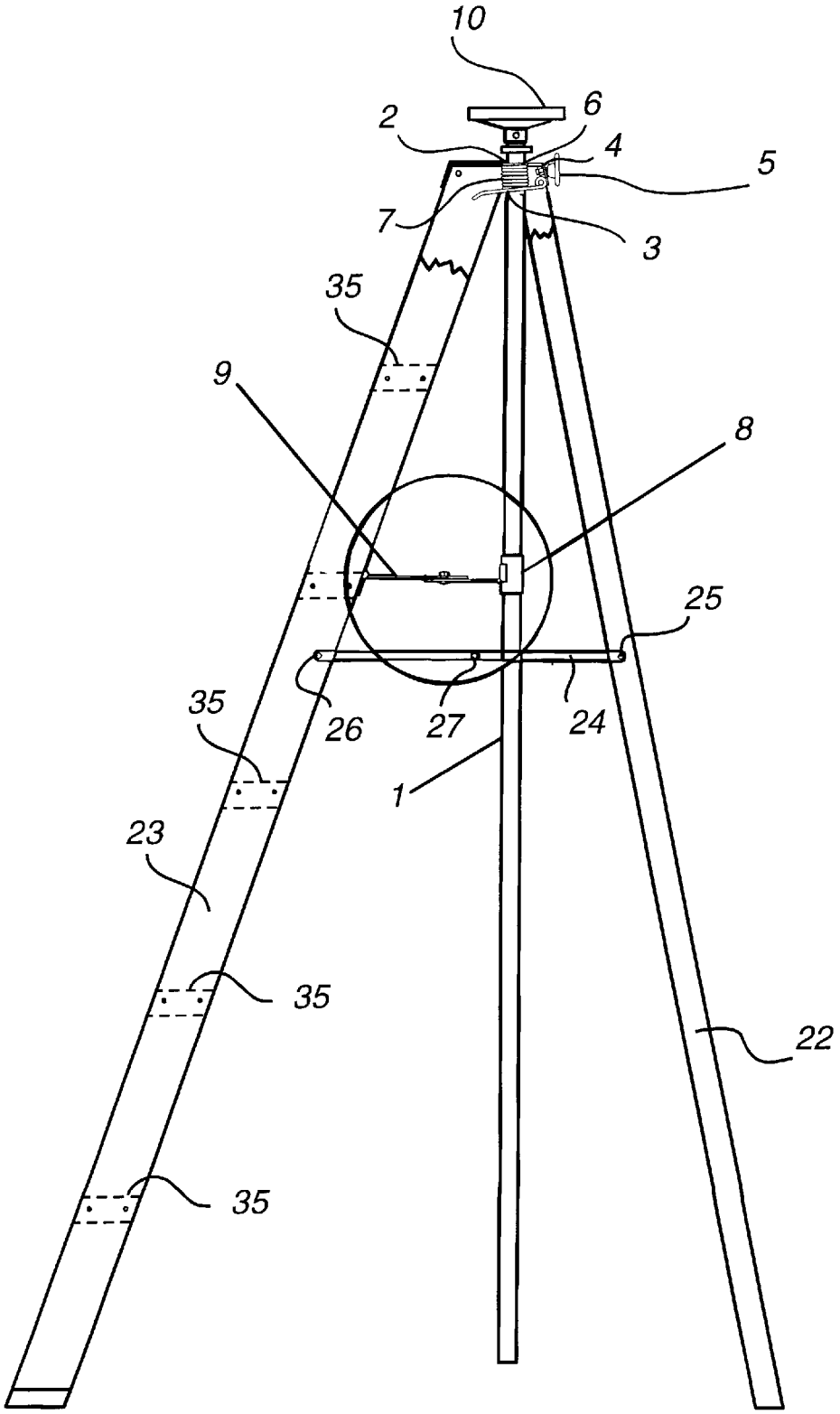
FIG. 1 is a side elevational view of a ladder and corresponding vertically adjustable work support system in accordance with an embodiment of this invention, FIG. 1 illustrating the system where the ladder's opposing legs are spread for normal ladder use and a tube of the support system extending upward between the opposing legs.

Referring now more particularly to the accompanying drawings where like reference numerals indicate like parts throughout the several views.

The work support system is adapted to be used in conjunction with a ladder having opposing legs that are spreadable relative to one another. The support system includes a single or multiple centrally located work support tube(s) or shaft(s) that is/are infinitely height adjustable within the working length of the tube(s)/shaft(s). While the elongated vertically adjustable member may be either a shaft(s) or tube(s), it will be referred to hereinafter as a tube for the sake of simplicity, but without limitation.

Figure 2:
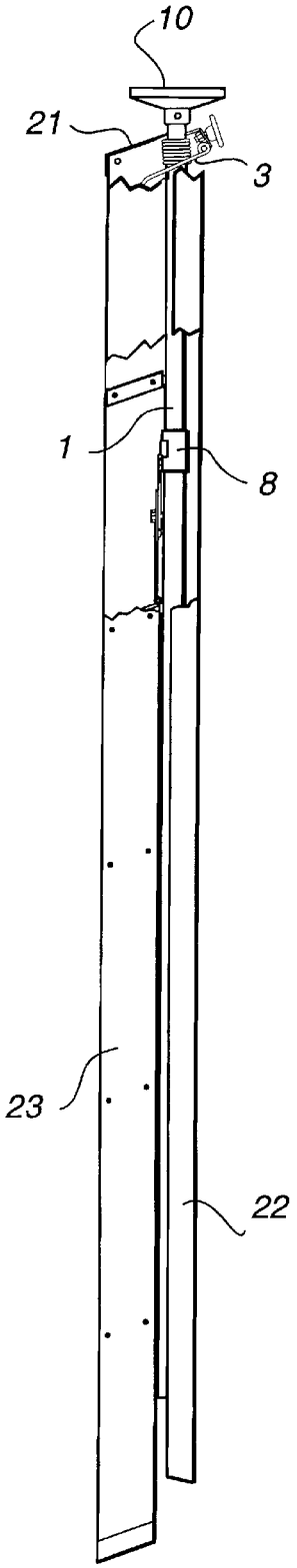
FIG. 2 is a side elevational view of the ladder and support system of FIG. 1, where the ladder's opposing legs are closed and the support tube is stored between the legs.
Figure 12:
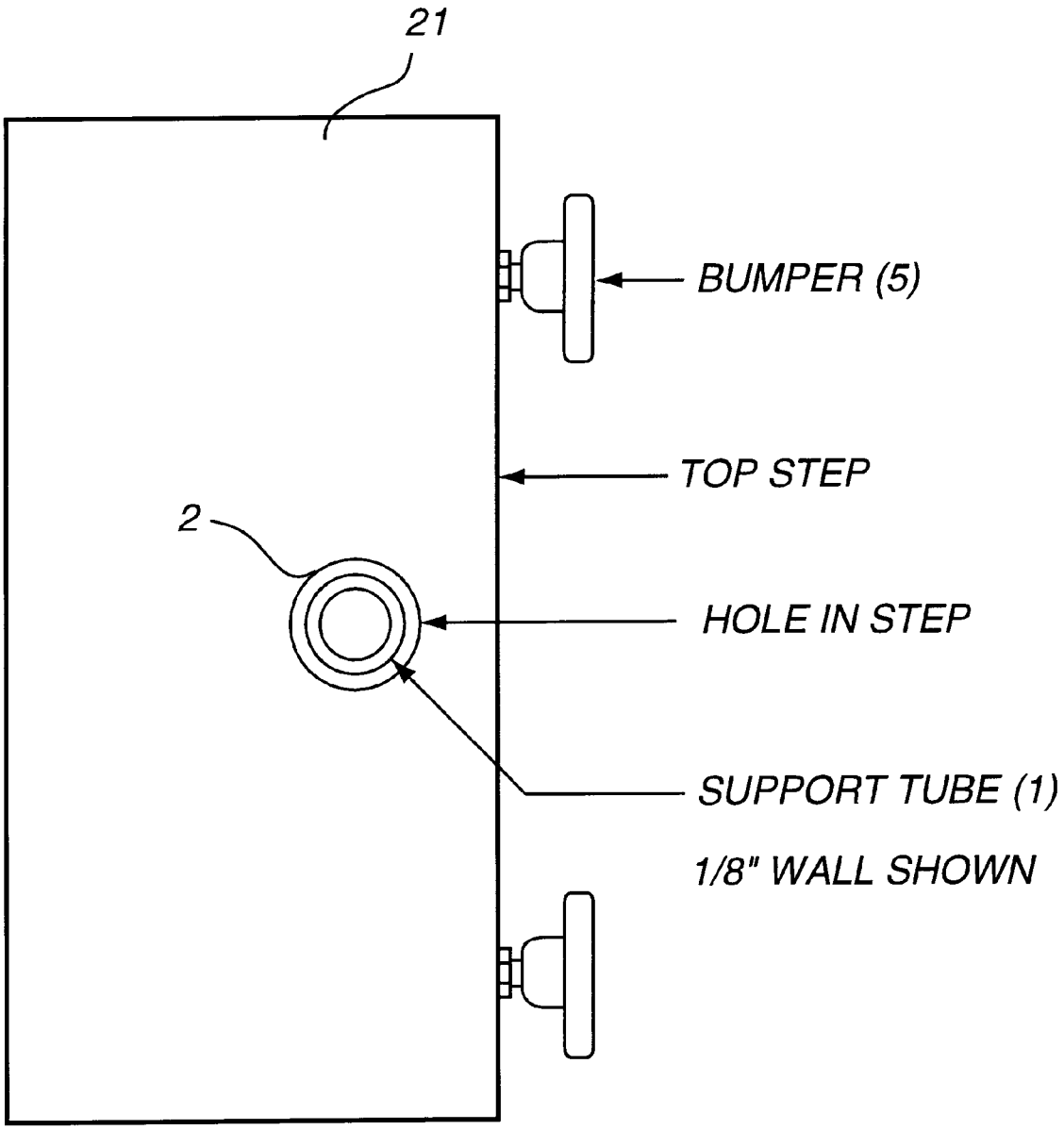
FIG. 12 is a top view of the assembly of FIGS. 1–11, illustrating the top of the ladder assembly.

As shown in FIGS. 1–2 and 12, elongated work support tube (1) extends through top platform (21) of a ladder at location (2) and is held in position by lock plate (3). The ladder includes a pair of opposing supporting legs (22 and 23) that are laterally spreadable or moveable relative to one another. The legs (22 and 23) can pivot relative to one another about a pivot point at the top of the ladder proximate ladder top platform 21. Legs (22 and 23) are shown in the open position in FIG. 1 supporting the ladder on a flat surface such as a floor, while the legs are shown in FIG. 2 in a closed position for storage. In the FIG. 2 position, only leg (23) supports the ladder, as the other leg (22) is not in contact with the ground. At the tops of the two legs (22 and 23) a ladder support platform (21) is provided, which is approximately flat when the legs are open as shown in FIG. 1. Ladder support cross member (24), including pivots (25–27), extends between and is connected to ladder legs (22 and 23) so as to support the legs relative to one another and prevent the legs from spreading too far from each other. When legs (22 and 23) are open relative to one another as shown in FIG. 1, elongated tube/shaft (1) extends upward between the legs and through an aperture, cavity, cutout, or void provided in platform 21 so that a work support platform (10), supported by and connected to tube (1), can be located at different vertical locations above and over top of ladder platform (21).

Lock plate (3) also guides and maintains work support tube (1) in different vertical positions, but maintains the tube against significant lateral movement relative to the ladder support platform (21). Plate (3) further functions to be located completely about tube (1) so as to help guide the tube (1) as its height is vertically adjusted between different vertical positions. This lock and guide assembly includes plate (3), as shown in FIGS. 5–6, with a hole or aperture (18) defined therein of a size slightly larger than the work support tube (1). Support plate (4) is attached or in operative relation with lock plate (3) by way of offset hinge or other type of pivot point (17). Plate (4) serves to distribute weight evenly along the length of the top ladder platform (21), along with elements in operative relation therewith including locking washer (6) having defined therein a hole slightly larger than the work support tube (1), and coil spring (7). Coil spring (7), in certain embodiments, may surround tube (1) as the tube extends therethrough.

Figure 3:
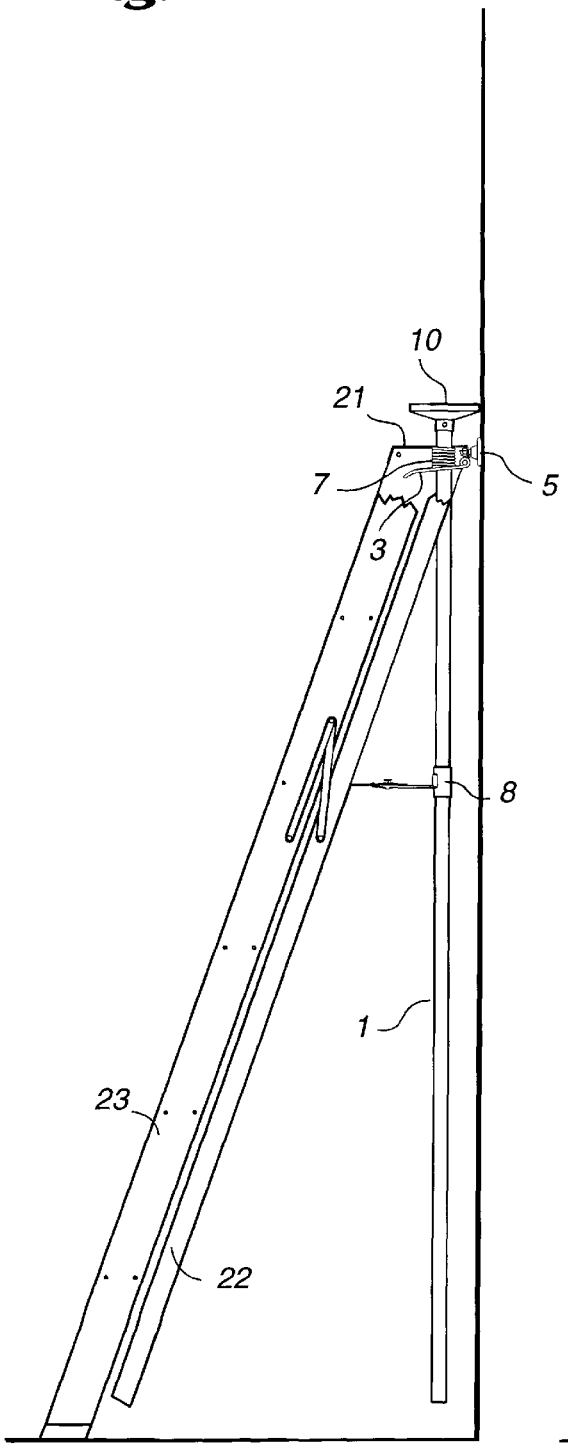
FIG. 3 is a side elevational view of the ladder and support system of FIGS. 1–2, where the ladder's legs are closed but the ladder is leaned against and supported by a vertical wall surface, and wherein the tube of the support system is in a lowered position.
Figure 4:
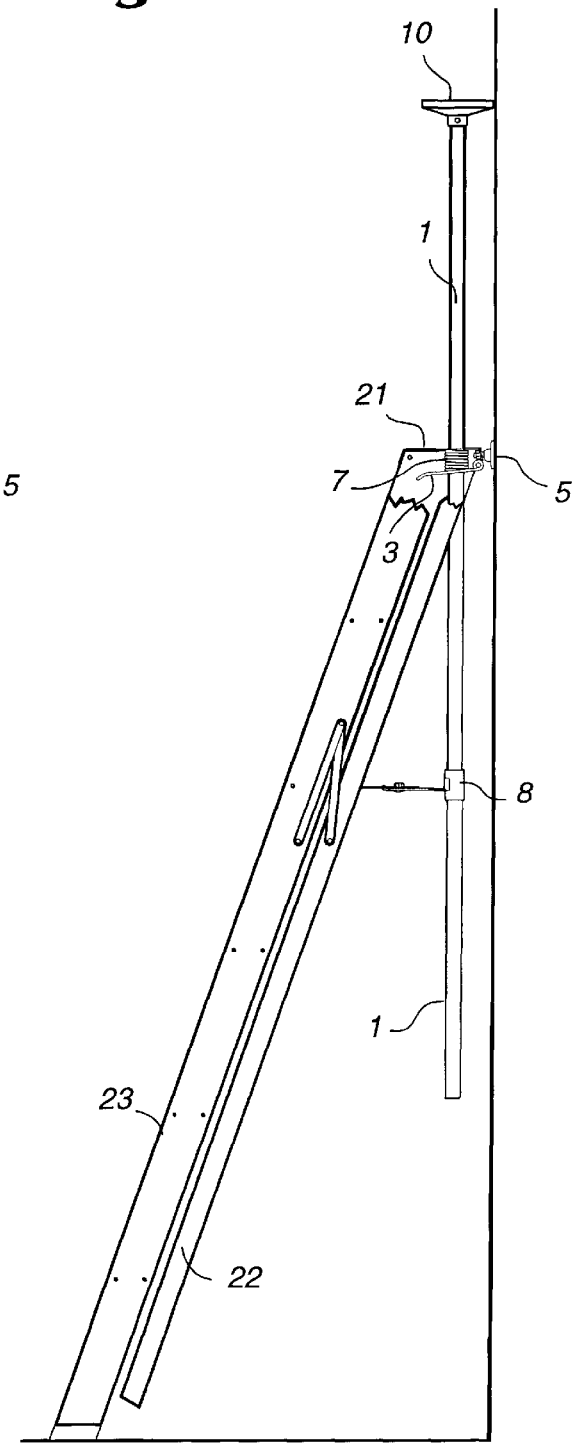
FIG. 4 is a side elevational view of the ladder and support system of FIG. 3, wherein the tube is in a raised position relative to the FIG. 3 position.

Attached to plate (4) are non-marring, pivoting, wall rest bumpers (5) which function to prevent damage when the ladder is leaned against a vertical surface such as a wall. For example, when the ladder is leaned against a wall as shown in FIGS. 3–4, wall rest bumpers (5) contact the wall and support the ladder against same. Because bumpers (5) are pivotally attached to plate (4), the bumpers can support the ladder and work support assembly against walls of different angles (i.e. not just perfectly vertical walls).

Work support tube (1), which extends through the close fitting hole or aperture in lock plate (3), binds with lock plate (3) with downward movement. The work support tube can be positioned upward to any height by simply lifting it, and is infinitely adjustable within the working length of the work support tube. When moved, tube (1) moves through and is guided by the aperture (18) defined in plate (3). The work support tube is quickly released and lowered by lifting the lock plate (3) on the end (29) opposite the pivot point or hinge (17), which in turn releases the binding action between the lock plate (3) aperture (18) and the exterior periphery of work support tube (1). In the manner set forth above, plate (3) and tube aperture (18) defined therein function to guide tube (1) and maintain the tube in a given lateral position relative to the top of the ladder leg(s) to which plate (3) is connected.

As shown in FIGS. 1–2, pivoting guide bushing (8), including a tube aperture defined therein for slidably receiving tube (1), is attached to adjustable pivoting support plate (9), located at an elevation or level substantially below lock plate (3). Bushing (8) provides lateral stability for the work support tube (1) which extends therethrough. Referring to FIGS. 1 and 9–11, lower support plate (9) is attached to the ladder's main legs (23), or a step between the main legs, and is supported in the horizontal position. Referring to FIGS. 9–11, plate 9 is vertically pivotal about horizontal pivot or hinge (30) at bushing (8), and about horizontal pivot or hinge 31 between plate (9) and hinge plate (32). Plate (32) may be attached to a step or rung of the ladder for example, or directly to the main legs (23).

Referring to FIGS. 1–2 and 9–11, when storing the ladder, pivoting lower support plate (9) is tilted upwards about pivot (31), as shown in FIGS. 2 and 11, while the supporting bushing (8) slides and/or pivots with respect to the work support tube (1) extending therethrough. The vertical pivoting of plate (9), when moving the ladder and tube (1) to the storage position, causes the tube to move closer to legs (23) and also closer to legs (22) as the legs (22 and 23) move relatively toward one anther. This repositioning of the work support tube toward its storage position causes upper washer (6) (FIG. 5) to pivot/move downwards, thereby causing the washer to lock the work support tube in the reverse direction and in its retracted storage position, approximately parallel and next to the ladder's main support legs shown in FIG. 2. Thus, when the ladder is to be folded for storage, the lower support plate (9) and guide bushing (8) are pivoted up (or down) and towards the front of the ladder. This angles the work support tube parallel to the steps (35) of the ladder and causes the upper lock plate assembly washer to pivot downward with respect to the ladder's top platform causing the washer to lock on the work support tube. This prevents the work support tube from sliding out of the ladder. The ladder legs are now folded together leaving the work support system completely enclosed and contained within the ladder.

After opening the stepladder (i.e. from its FIG. 2 position to its FIG. 1 position), the integral work support system can be moved to its working position. The work platform base (10) can be quickly changed by removing a quick release pin (11), changing the platform base and replacing the pin (11). The pin (11) and platform (10) are shown, for example, in FIG. 7. For purposes of example, to install a light fixture on a ceiling, the ladder would be put in position as shown in FIG. 1, the fixture placed on the platform (10) and the platform and tube (1) lifted to the required height. The pivoting lock plate (3) assembly will automatically hold the platform at that precise position, and prevent it from falling downward. The more weight that needs to be held, the tighter the lock plate (3) locks.

When the work support (10) is no longer required, it can be lowered to any position by lifting on the lock plate release arm (29). This causes the locking action of plate (3) to be released, thereby causing tube (1) to fall downward through the tube apertures in plate (3) and bushing (8).

Referring to FIGS. 3–4, the work support unit can also be used to support items by leaning the ladder against an approximate vertical surface such as a wall. In this case the ladder and work support assembly are unfolded to the FIG. 1 position to allow the work support tube to be raised. For example, the tube (1) may be raised to a height such that its lower end is above the highest step (35) on each leg (22, 23). When the work support tube is fully extended upwardly in such a manner, the ladder legs (22, 23) are closed relative to one another and the work support tube (1) is lowered to the position shown in FIG. 3. The ladder can now be placed against the wall as shown in FIG. 3, and the platform (10) and load thereon raised to the required height as shown in FIG. 4. To move the tube (1) to its storage position from the FIG. 4 position, tube (1) is raised so that its lower end is above the highest step (35) on either ladder leg, then the legs (22, 23) are opened or pulled apart relative to one another, tube (1) lowered to its FIG. 1 position, and then the storage steps outlined above are performed.

In certain embodiments of this invention, lock plate (3) has at least one bumper (5) pivotally attached thereto (see FIGS. 5–6) to pivot from approximately ¼ inch studs. The studs are shown in FIGS. 1–2 to have nuts that mount the lock plate to the inside rear of the ladder top. The lock plate could be mounted to the back side of the ladder as well in other embodiments. Once holes for the bumper studs are drilled, the lock plate may be held against the inside of the ladder top platform and the bumper studs inserted through the step, through the lock plate, then nuts tightened onto the studs. In FIGS. 5–6, the plate (3) is shown to also have six or so additional apertures or holes along its length, two in the center and one on either side of each bumper (5). These holes may be used with rivets or screws and nuts to fasten the lock plate to the ladder top.

FIG. 12 is a top view of the assembly of FIGS. 1–11. As illustrated in FIG. 12, tube (1) extends at least partially, and potentially fully, through aperture (2) in the top (21) of the ladder assembly. Multiple bumpers (5) are provided for leaning the ladder against walls and the like as discussed above. Additionally, in certain embodiments not meant to be limiting in any way, tube (1) has a wall diameter of approximately ⅛ inch. Other wall thicknesses are also contemplated. Moreover, member (1) may be a bar or elongated piece of fiberglass instead of the illustrated steel or aluminum tube. In certain embodiments, tube (1) fits into aperture (2) in a manner enabling the tube to slide therethrough as discussed above.

Once given the above disclosure, many other features, modifications, and improvements will become apparent to the skilled artisan. Such other features, modifications, and improvements are, therefore, considered to be a part of this invention, the scope of which is to be determined by the following claims.

I claim:

1. A ladder system adapted to be leaned against a vertical wall, the ladder system including a vertically adjustable work support assembly, and the ladder system comprising:

a ladder including first and second legs that are pivotal relative to one another, said first and second legs adapted to be opened to a position where said first and second legs together support the ladder, and each of said first and second legs having a respective top end;

a plurality of steps provided on at least one of the first and second legs, said steps enabling a user to stand on or climb the ladder;

a vertically moveable elongated support member extending vertically said vertically adjustable work support assembly includes a upward between said first and second legs, said elongated support member having a top end positionable at an elevation above the top end of at least one of said first and second legs, and wherein said elongated support member is vertically slideable upward and downward through a top portion of the ladder;

a work piece support proximate the top end of the elongated support member, said work piece support to receive work pieces thereon and being vertically moveable along with said elongated support member and;

means for vertically moving said elongated support to be member in a direction approximately parallel to the vertical wall when the first and second legs of the ladder are in a closed position and when the ladder is to be leaned against the wall and said ladder is being supported by at least one of said first and second legs, and wherein said elongated support is at least partially located on a single common side of said first and second legs when the legs are in a closed position and the ladder is to be leaned against the wall, further including a first support assembly located adjacent to the tap portion of the ladder, and includes a support plate connected to a side of the top portion of the ladder and having non-marring bumpers attached thereto, a lock plate hinged to the support plate and having an aperture defined therein for slidably receiving said elongated support member, a locking washer receiving said elongated support member for preventing the elongated support member form sliding out from between the legs of the ladder, a coil spring disposed between said locking washer and said lock plate, and a second support assembly including an aperture therein for laterally supporting said elongated support member, and wherein said first and second support assemblies are located at different elevations.

2. The ladder system of claim 1, wherein said elongated support member includes an elongated tube, and a collar near a top of the tube for preventing the tube from falling out when the work piece support is removed.

3. The ladder system of claim 1, wherein said second support assembly includes a bushing including an apertures defined therein for slideably receiving said elongated support member, and a plate pivotally attached to said bushing, and wherein the second support assembly is adjustable.

4. The ladder system of claim 1, further including means for enabling the elongated support member to be stored in a storage position where a majority of said elongated support member is located between the first and second legs of the ladder.

5. The ladder system of claim 1, further including a selectively removeable pin disposed in said elongated support member near the top end thereof, said pin for enabling different work piece supports to be interchangeably attached to the top end of said elongated support member.

6. The ladder system of claim 1, further comprising means for moving said work piece support vertically upward and downward through a plurality of different vertical positions along with said elongated support member so that in all of said different vertical positions said work piece support is approximately centered over top of the ladder so as to minimize the possibility of tipping of the ladder.

* * * * *